US007559804B2

(12) United States Patent
Cheng

(10) Patent No.: US 7,559,804 B2
(45) Date of Patent: Jul. 14, 2009

(54) CARD CONNECTOR

(75) Inventor: Yung-Chang Cheng, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 70 days.

(21) Appl. No.: 11/805,155

(22) Filed: May 22, 2007

(65) Prior Publication Data

US 2007/0270005 A1 Nov. 22, 2007

(30) Foreign Application Priority Data

May 22, 2006 (TW) ..... 95208801 U

(51) Int. Cl.
*H01R 24/00* (2006.01)

(52) U.S. Cl. ..... 439/630; 361/737

(58) Field of Classification Search ..... 439/76, 439/159, 607, 630, 631, 946; 361/737
See application file for complete search history.

(56) References Cited

U.S. PATENT DOCUMENTS 6,102,708 A * 8/2000 Kimura ..... 439/64
6,394,843 B1 * 5/2002 Chang et al. ..... 439/607
6,955,548 B1 * 10/2005 Wang et al. ..... 439/159
6,962,500 B1 * 11/2005 Chen ..... 439/159
6,988,904 B1 * 1/2006 Lai ..... 439/159
7,018,222 B2 * 3/2006 Chang ..... 439/159

FOREIGN PATENT DOCUMENTS

TW 094217451 3/2006

* cited by examiner

*Primary Examiner*—Thanh-Tam T Le
(74) *Attorney, Agent, or Firm*—Wei Te Chung

(57) ABSTRACT

A card connector assembled on a bracket, comprises an insulating housing, a plurality of contacts received in the insulating housing, the shell covering the insulating housing and a holding device. The insulating housing defines a card insertion/ejection direction. The holding device is disposed on the shell, one of the holding device and the bracket defining a receiving portion and the other of the holding device and the bracket having a mating portion to be received in the receiving portion.

10 Claims, 5 Drawing Sheets

CARD CONNECTOR

BACKGROUND OF THE INVENTION

1. Field of the Invention

The present invention is generally related to a card connector, and more particularly, to a card connector which has a holding device.

2. Description of Related Art

With the development of electronic appliances, different electrical cards are used to expand additional functions of the electronic appliance, such as data storage. A card connector is required to receive the electrical card to achieve the storage or transmission of signal between the electrical card and the corresponding electronic appliance. For adapting to requirements to a card, an express card, which has quicker speed than a conventional card at data transmission are achieved. In order to satisfy requirements of assembly and space, an express card connector receiving the express card is usually assembled on a bracket, such as a bracket of hard disk drive (HDD).

Taiwan Patent Application No. 094217451 discloses an express card connector which is assembled on a bracket. Referring to FIGS. 9-10, the express card connector comprises an insulating housing, a plurality of contacts received in the insulating housing and a shell covering the insulating housing. The shell is formed with holding devices defining screw holes. Copper columns are rivet on the bracket to mate with the screw holes of the shell in virtue of screws to assemble the connector on the bracket.

However, when the connector is assembled on the bracket, the copper columns must be rivet on the bracket firstly. Furthermore, the copper columns must be cut internal thread to mate with the corresponding screws. Apparently, it requires much procedure and increases difficulty and costs of manufacturing and assembly.

Hence, an improved card connector is required to overcome the disadvantages of the related art.

SUMMARY OF THE INVENTION

Accordingly, an object of the present invention is to provided a card connector which has a holding device.

To achieve the above objects, a card connector assembled on a bracket, comprises an insulating housing, a plurality of contacts received in the insulating housing, the shell covering the insulating housing and a holding device. The insulating housing defines a card insertion/ejection direction. The holding device is disposed on the shell, one of the holding device and the bracket defining a receiving portion and the other of the holding device and the bracket having a mating portion to be received in the receiving portion.

Other objects, advantages and novel features of the present invention will be drawn from the following detailed description of a preferred embodiment of the present invention with attached drawings.

DETAILED DESCRIPTION OF THE INVENTION

Reference will now be made in detail to the preferred embodiment of the present invention.

Referring to FIGS. 1-4, a card connector 1 in accordance with the present invention is assembled on a bracket 100. The card connector 1 is approximately L-shaped and can receive a rectangular card or a L-shaped card (not shown). In this embodiment, the bracket 100 is used to hold a hard disk drive (HDD) (not shown).

Figure 3:
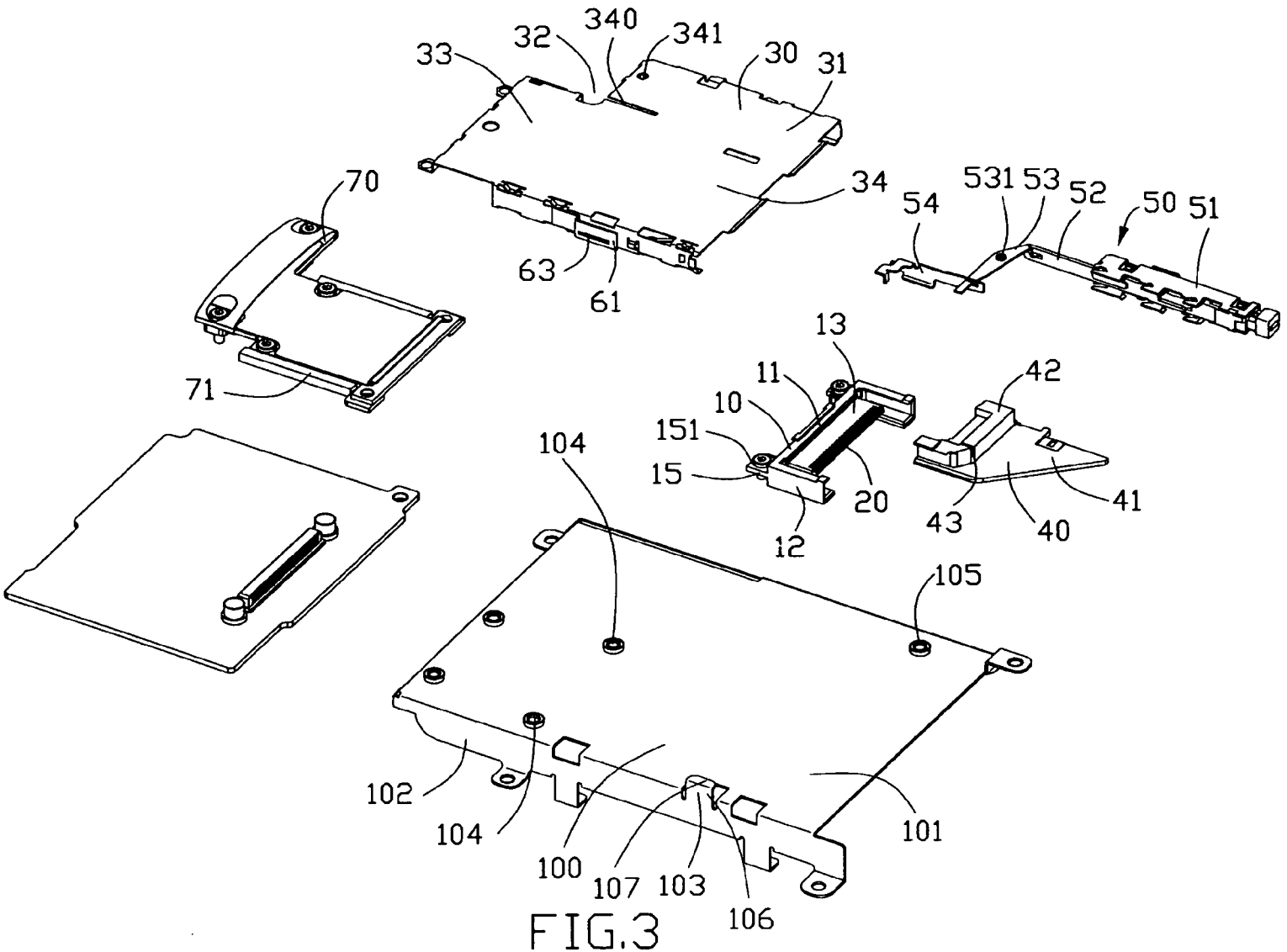
FIG. 3 is an exploded, perspective view of the card connector, the bracket, the daughter board and the main board shown in FIG. 1.
Figure 4:
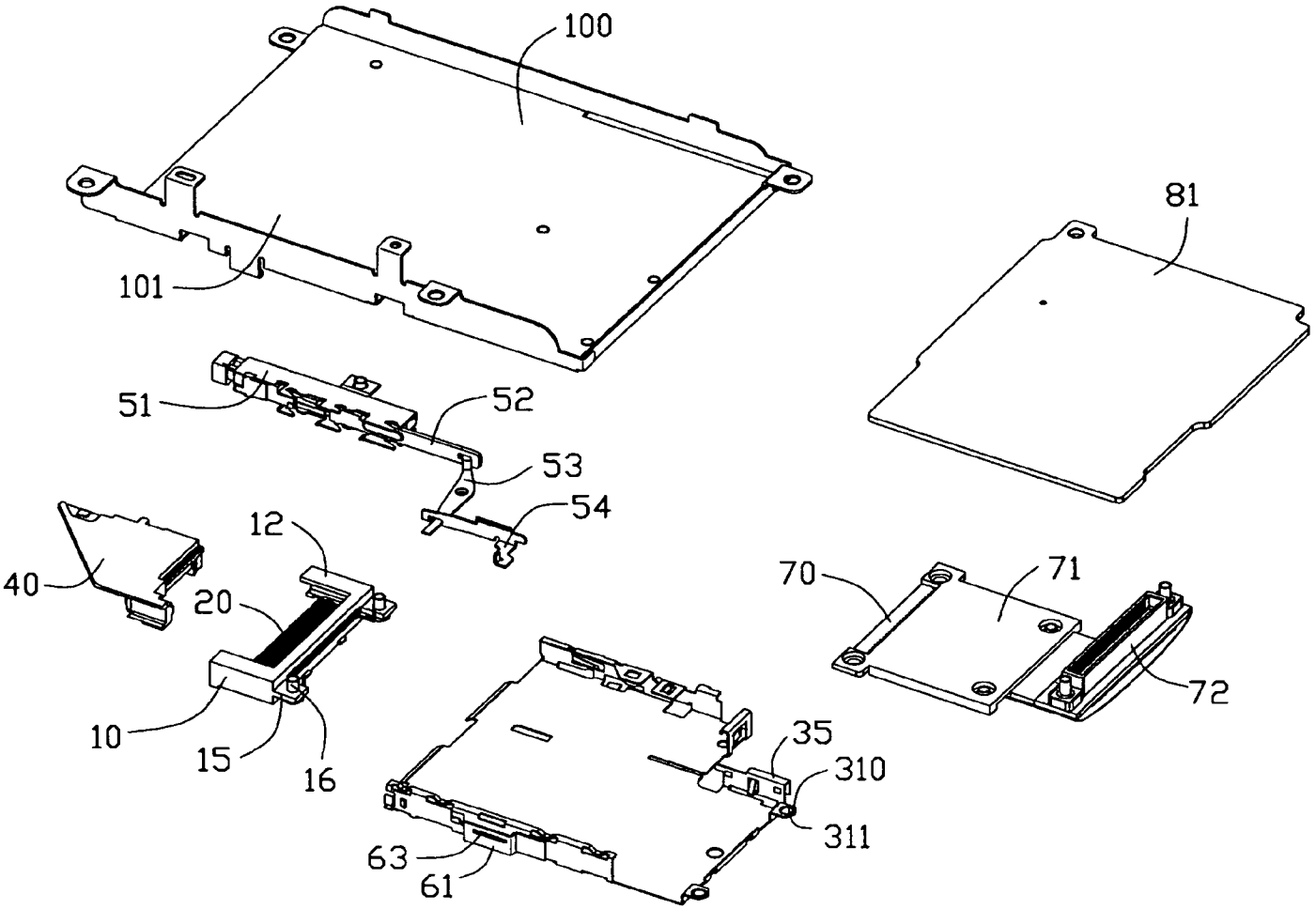
FIG. 4 is an exploded, perspective view similar to FIG. 3, but from another aspect.
Figure 5:
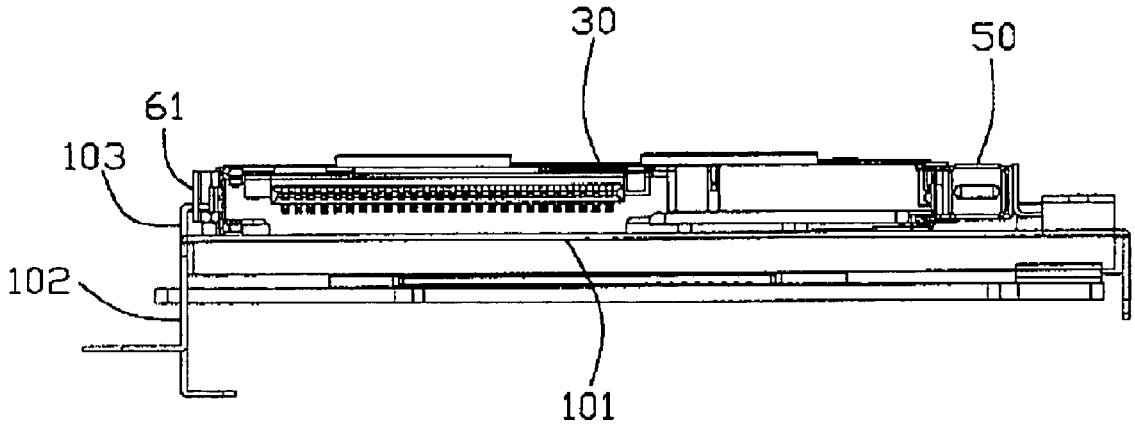
FIG. 5 is a front elevational view of the present invention.

Referring to FIG. 3, the bracket 100 is approximately frame configuration and comprises a main plate 101 and a pair of side portions 102 extending downwardly from opposite laterals of the main plate 101. The card connector 1 is assembled on an outside of the main plate 101. A first and second columns 104, 105 are rivet on a front and rear ends of the main plate 101, respectively. The bracket 100 is formed with a mating portion 103 at a rear end of the left side portion 102 adjacent to the lateral of the main plate 101. The mating potion 103 comprises a connecting portion 106 extending upwardly from the left side portion 102 and beyond the main plate 101, and a locking portion 107 extending parallel to the main plate 101 from a free end of the connecting portion 106.

Referring to FIGS. 1-4, the card connector 1 comprises an elongated insulating housing 10, a plurality of contacts 20, a shell 30, a guide element 40, an ejector 50 disposed on the shell 30 and a pair of holding devices 61, 62.

The elongated insulating housing 10 has a base 11, a pair of guiding arms 12 and a pair of assembling plates 15 extending forwardly from opposite sides of the base 11 respectively. A mating portion 13 extends from a lower part of the base 11 and is disposed between the two guiding arms 12. The assembling plates 15 define column holes 151. The contacts 20 are received in the mating portion 13 and extend beyond the insulating housing 10 to be soldered on a daughter board 70.

The shell 30 covers the insulating housing 10 to define a card receiving space 80 therebetween. The shell 30 is L-shaped because the shell 30 defines a step portion 32 at front end thereof. The L-shaped shell 30 comprises a main body 31 and sidewalls (not labeled) extending downwardly from the main body 31. The main body 31 comprises a front section 33 and a rear section 34 extending rearward from the front section 33. The width of the rear section 34 is wider than that of the front section 33 along a transverse direction perpendicular to a card insertion/ejection direction. The front section 33 of the shell 30 is formed with a pair of holding pieces 310 with through holes 311 at opposite sides of a front end thereof. Moreover, an U-shaped sidewall 35 extends downwardly from a lateral side of the front section 33 adjacent to the step portion 32. A slot 340 is defined at the rear section 34 and is in alignment with the U-shaped sidewall 35 along the card insertion/ejection direction. A pivoting hole 341 is defined at the rear section 34 adjacent to the step portion 32. Screws 16 are secured in the column holes 151 of the insulating housing 10, the through holes 311 of the shell 30 and columns 104 disposed on the bracket 100 to assemble the card connector 1 on the bracket 100.

The holding device 61 is assembled on a rear end of the sidewall of shell 30 apart from the step portion 32 and defines a receiving portion 63 corresponding to the locking portion 107 of the bracket 100 along the card insertion direction. In this embodiment, the receiving portion 63 is a rectangular slot.

The guide element 40 is approximately a triangle shape and assembled to the shell 30 adjacent to the step portion 32. The guide element 40 has a board 41 and a L-shaped perpendicular wall 42 extending forwardly and upwardly from a front end of the board 70. The wall 42 defines a passageway 43 communicating with the slot 340 of the shell 30 along a vertical direction.

Referring to FIGS. 1-4, the ejector 50 comprises a push member 51, a moveable member 52, a pivoting member 53 and an ejecting member 54. The push member 51 is known to one ordinary skill in the art. Thus, details of the push member 51 will not be illustrated. The push member 51 is assembled on a sidewall of the shell 30 adjacent to the step portion 32. A rear end of the moveable member 52 is received in the push member 51 moveably and a front end thereof defines a rectangular hole (not labeled) to moveably receive one end of the pivoting member 53. The other end of the pivoting member 53 is received in a hole (not labeled) defined at a rear end of the ejecting member 54. The other end 522 is bifurcated to receive a rear end 532 of the ejecting member 53. The pivoting member 53 has a pivoting portion 531 in a middle portion thereof to be pivotally held in a pivoting hole 341 of the shell 30. A front section of the ejecting member 54 is moveably received in the U-shaped sidewall 35 and a rear end of thereof moves along the slot 340 and the passageway 43. The holding device 62 is rivet on the push member 51 and defines a circular hole (not labeled). A screw 17 passes through the circular hole of the holding device 62 and the second column 105 to make the holding device 62 be secured in the bracket 100.

Figure 1:
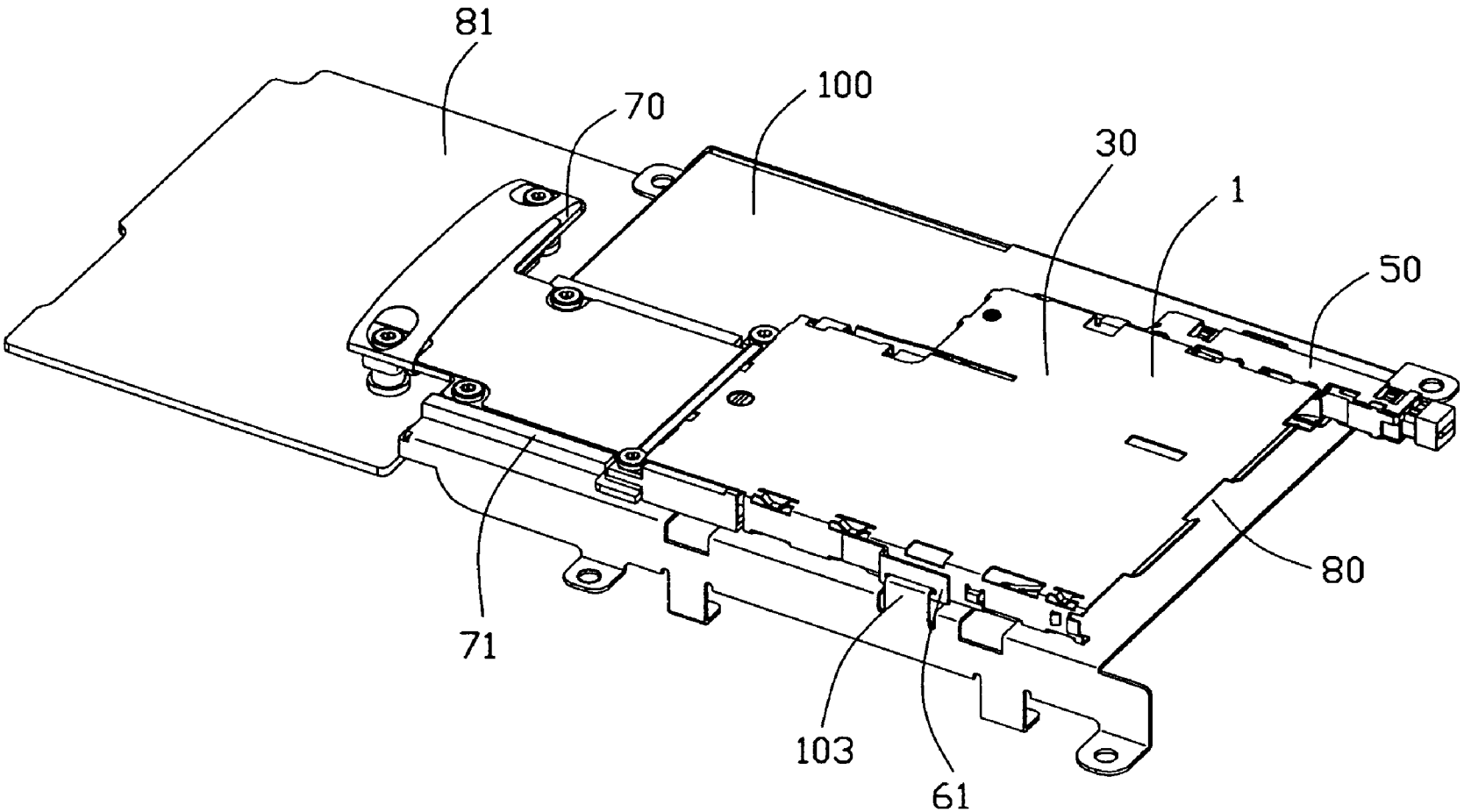
FIG. 1 is an assembled, perspective view of the card connector, a bracket, a daughter board and a main board in accordance with the present invention.

Referring to FIG. 1, when the card connector 1 is assembled on the bracket 100, the locking portion 107 of the mating portion 103 is just inserted into the receiving slot 63 of the holding device 61 so that the card connector 1 is held on the bracket 100. Comparing to the prior art, the cooperating way of the present invention is apparently simple and easily manufactured. Certainly, in the present invention, the bracket 100 can also define a receiving slot to receive a locking portion disposed in the holding device 61.

Figure 2:
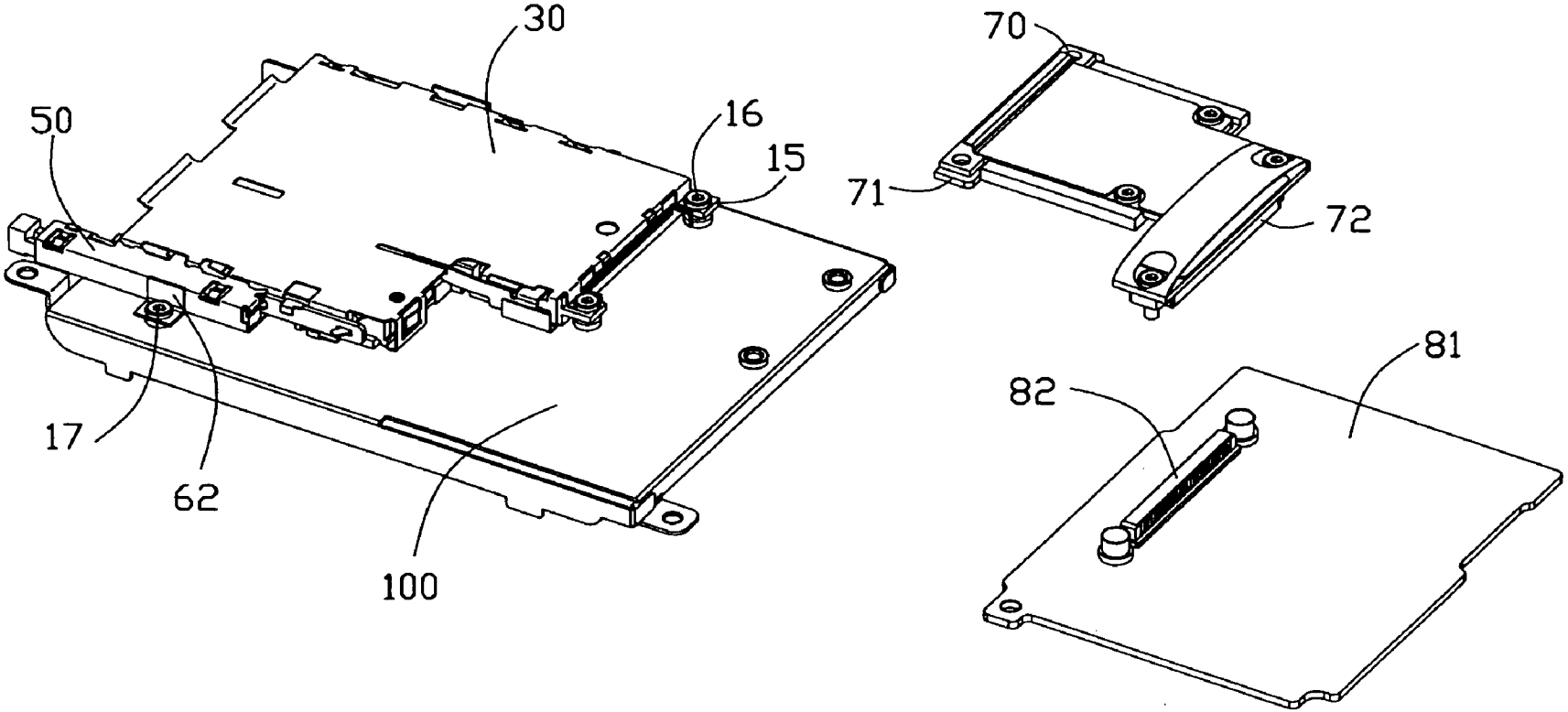
FIG. 2 is a partly assembled, perspective view of the card connector, the bracket, the daughter board and the main board shown in FIG. 1.

Referring to FIGS. 1-3, the daughter board 70 is disposed on a resin pad 71. Rear ends of the daughter board 70 and the resin pad 71 adjacent to the insulating housing 10 define mating holes (not labeled) corresponding to the through holes 311, the column holes 151 and the columns 104. Thus, the daughter board 70 and the resin pad 71 are mounted on and extending parallel along the bracket 100. A first board-to-board connector 72 is disposed on a front end of the daughter board 70 to mate with a second board-to-board connector 82 disposed on a main body 81 to attain electrical connection among the contacts 20, the daughter board 70 and the main body 81.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A card connector assembly comprising:

a bracket defining a peripheral device receiving space;

an insulating housing defining a card insertion/ejection direction;

a plurality of contacts received in the insulating housing;

a shell covering the insulating housing and defining a card receiving space; and a holding device disposed on the shell, one of the holding device and the bracket defining a receiving portion and the other of the holding device and the bracket having a mating portion to be received in the receiving portion; wherein the card receiving space is stacked upon the peripheral device receiving space; wherein the bracket comprises a main plate and side portions extending downwardly from the main plate; wherein the mating portion comprises a connecting portion extending from one of the side portion and a locking portion extending parallel from a free end of the connecting portion, and wherein the locking portion is received in the receiving portion.

2. The card connector assembly as claimed in claim 1, wherein the mating portion is unitary with the bracket.

3. The card connector assembly as claimed in 1, wherein the receiving portion is a rectangular slot.

4. The card connector assembly as claimed in claim 1, wherein the bracket is used to hold a hard disk drive.

5. The card connector assembly as claimed in claim 1, wherein the shell is approximately L-shaped.

6. The card connector assembly as claimed in claim 5, further comprising an ejector assembled on the shell.

7. The card connector assembly as claimed in claim 6, wherein the ejector comprises a push member, a moveable member with one end moveably received in the push member, an ejecting member and a pivoting member connecting the moveable member and the ejecting member.

8. The card connector assembly as claimed in claim 6, further comprising another holding device assembled on the ejector to mate with a column disposed on the bracket.

9. The card connector assembly as claimed in claim 1, further comprising a daughter board assembled parallel on the bracket, the contacts extending beyond the insulating housing to electrically connect with one end of the daughter board.

10. The card connector assembly as claimed in claim 9, wherein the daughter board is formed with a first board-to-board connector at the other end thereof to mate with a second board-to-board connector disposed on a main board.

* * * * *